US008794323B2

(12) United States Patent
Luce et al.

(10) Patent No.: US 8,794,323 B2
(45) Date of Patent: Aug. 5, 2014

(54) COMPLETION ASSEMBLY

(75) Inventors: Thomas A. Luce, Cypress, TX (US); Karen Olson, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 597 days.

(21) Appl. No.: 12/218,674

(22) Filed: Jul. 17, 2008

(65) Prior Publication Data

US 2010/0012318 A1 Jan. 21, 2010

(51) Int. Cl.
*E21B 43/04* (2006.01)

(52) U.S. Cl.
USPC ..... 166/278; 166/51

(58) Field of Classification Search
USPC ..... 166/51, 228, 278
See application file for complete search history.

(56) References Cited

U.S. PATENT DOCUMENTS

| | | | | |
|---|---|---|---|---|
| 2,725,107 | A | 11/1955 | Abendroth et al. | |
| 4,401,158 | A * | 8/1983 | Spencer et al. | 166/51 |
| 4,576,233 | A | 3/1986 | George | |
| 4,858,690 | A * | 8/1989 | Rebardi et al. | 166/278 |
| 5,597,040 | A * | 1/1997 | Stout et al. | 166/51 |
| 5,609,204 | A * | 3/1997 | Rebardi et al. | 166/51 |
| 5,865,251 | A * | 2/1999 | Rebardi et al. | 166/278 |
| 5,921,318 | A * | 7/1999 | Ross | 166/250.17 |
| 6,095,245 | A | 8/2000 | Mount | |
| 6,446,729 | B1 * | 9/2002 | Bixenman et al. | 166/386 |
| 6,464,006 | B2 | 10/2002 | Womble et al. | |
| 6,513,599 | B1 * | 2/2003 | Bixenman et al. | 166/378 |
| 6,644,412 | B2 | 11/2003 | Bode et al. | |
| 6,675,893 | B2 | 1/2004 | Lund | |
| 6,857,476 | B2 * | 2/2005 | Richards | 166/278 |
| 6,918,440 | B2 * | 7/2005 | Garcia-Soule et al. | 166/142 |
| 6,983,795 | B2 * | 1/2006 | Zuklic et al. | 166/51 |
| 7,063,164 | B2 | 6/2006 | Hilsman et al. | |
| 7,134,505 | B2 * | 11/2006 | Fehr et al. | 166/387 |
| 7,234,533 | B2 * | 6/2007 | Gambier | 166/387 |
| 7,337,840 | B2 * | 3/2008 | Penno | 166/278 |
| 7,478,676 | B2 | 1/2009 | East, Jr. et al. | |
| 7,520,326 | B1 * | 4/2009 | Hill et al. | 166/278 |
| 7,575,062 | B2 | 8/2009 | East, Jr. | |
| 7,735,559 | B2 * | 6/2010 | Malone | 166/313 |
| 7,753,131 | B2 * | 7/2010 | Brooks | 166/387 |
| 2001/0020533 | A1 * | 9/2001 | Salies | 166/358 |

(Continued)

FOREIGN PATENT DOCUMENTS

WO 2005/100743 A1 10/2005

OTHER PUBLICATIONS

Baker Hughes, Reactive Element Packers, accessed Jul. 14, 2010 at http://www.bakerhughes.com/products-and-services/completions-and-productions/well-completions/liner-systems-wellbore-isolation/reactive-element-packers.*

(Continued)

*Primary Examiner* — Blake Michener
(74) *Attorney, Agent, or Firm* — Barbara Fisher

(57) ABSTRACT

A completion assembly useful to fracture pack, gravel pack or otherwise treat production intervals traversed by an uncased wellbore is presented. The completion assembly may be used to stimulate production and/or prevent production of solid particles from the production intervals. A single trip method to fracture pack, gravel pack or otherwise treat multiple zones in an open-hole wellbore is disclosed where the wellbore has no liner or casing string installed through a production open hole portion.

14 Claims, 2 Drawing Sheets

(56) References Cited

U.S. PATENT DOCUMENTS

| | | | | |
|---|---|---|---|---|
| 2004/0134655 | A1 | 7/2004 | Richards | |
| 2004/0134656 | A1 | 7/2004 | Richards | |
| 2005/0061508 | A1 | 3/2005 | Surjaatmadja | |
| 2005/0199401 | A1 | 9/2005 | Patel et al. | |
| 2006/0060352 | A1 | 3/2006 | Vidrine et al. | |
| 2006/0076133 | A1* | 4/2006 | Penno | 166/278 |
| 2006/0108115 | A1* | 5/2006 | Johnson | 166/278 |
| 2006/0124310 | A1 | 6/2006 | Lopez de Cardenas et al. | |
| 2007/0125532 | A1* | 6/2007 | Murray et al. | 166/179 |
| 2007/0125535 | A1* | 6/2007 | Coronado | 166/278 |
| 2007/0158060 | A1 | 7/2007 | Baaijens et al. | |
| 2008/0035349 | A1 | 2/2008 | Richard | |
| 2008/0110620 | A1* | 5/2008 | Penno | 166/278 |
| 2008/0149351 | A1* | 6/2008 | Marya et al. | 166/387 |
| 2008/0164027 | A1* | 7/2008 | Sanchez | 166/278 |
| 2008/0314589 | A1* | 12/2008 | Guignard et al. | 166/278 |
| 2009/0095471 | A1* | 4/2009 | Guignard et al. | 166/278 |
| 2009/0211759 | A1 | 8/2009 | East, Jr. et al. | |

OTHER PUBLICATIONS

PCT International Search Report and Written Opinion dated Feb. 9, 2010 for International Application No. PCT/US2009/050771.

Bruist, E.H., Well Completions in the Beta Field, Offshore California:Society of Petroleum Engineers; Mar. 24-25, 1983, 296-300 (Appendix-Drawings); 11696; SPE; Dallas, Texas, USA.

Jefferis, R.G., A Field Proven System for Selective, Multizone, One-Trip Gravel Packing; Society of Petroleum Engineers; Mar. 24-25, 1983, 305-309 (Appendix-Table-Drawings); 11697; SPE; Dallas, Texas, USA.

Bennett, John Scott, Multi-Zone Gravel Pack Techniques: Case Studies Form the South China Sea Xijiang Development; Society of Petroleum Engineers; Oct. 28-31, 1996, 23-34; 36950; SPE; Dallas, Texas, USA.

Sanders, T.K., Successful Integrated Engineering Service Contract in the South China Sea; Society of Petroleum Engineers; Oct. 30-31, 1996, 357-366; 37000; SPE; Dallas, Texas, USA.

Rodgers, J.T., A Review of Completions and Gravel-Pack Techniques of the Xijiang Development; Society of Petroleum Engineers Drilling & Completion; Dec. 1997, 249-255; 29956, SPE; Richardson, Texas, USA.

Hyne, N.J., "Dictionary of Petroleum Exploration, Drilling, & Production", 1991, p. 363, Pennwell Publishing Company, Tulsa, Oklahoma, USA.

Leecraft, J., "A Dictionary of Petroleum Terms", Third Edition, 1983, p. 110, Petroleum Extension Service, Division of Continuing Ed., The University of Texas at Austin, Austin, Texas, USA.

Weirich et al., "One Trip, Multiple Zone Gravel Packing Technique for Low-Pressure, Shallow Wells", Society of Petroleum Engineers, 1990, p. 356-360, 17590, SPE, Richardson, Texas, USA.

Coon et al., "Single trip Completion Concept Replaces Multiple Packers and Sliding Sleeves in Selective Multi-Zone Production and Stimulation Operations", Society of Petroleum Engineers; Apr. 1995, p, 1-5, 29539, SPE, Richardson, Texas, USA.

Bixenman et al., "Design and Deployment of and Intelligent Completion with Sand Control", Society of Petroleum Engineers; Sep. 30-Oct. 3, 2001, p. 1-9, 71674, SPE, Richardson, Texas, USA.

Gilmer et al., "World's First Completion Set Inside Expandable Screen", IADC-Society of Petroleum Engineers, Feb. 11-13, 2003, p. 1-10, 87201, SPE, Richardson, Texas, USA.

Walker et al., "Implementing a New Single Trip Multi Zone Frac Packing System With Integral Zone Isolation and Selective Production Capabilities", International Petroleum Technology Conference (Kuala Lumpur, Malaysia, Dec. 3, 2008-Dec. 5, 2008).

* cited by examiner

COMPLETION ASSEMBLY

FIELD OF THE INVENTION

The present invention relates to a completion assembly useful to fracture, gravel pack or otherwise treat a plurality of production intervals traversed by an uncased wellbore to stimulate fluid production, prevent production of solid particles, or both, from the production intervals. The invention relates to a single trip method to fracture, gravel pack or otherwise treat multiple zones in an uncased wellbore having no liner or casing string installed.

BACKGROUND OF THE INVENTION

In many instances the treatment of separate production intervals (zones) in a well has been accomplished by casing the well and thereafter perforating a zone to be treated for fracturing, gravel packing or the like. This requires that the well be cased in the zone to be treated and that perforations be placed in the casing to permit access to the subterranean production formation. This can require multiple trips of tubing into the well for operations, to exchange tooling, or the like. Further this can, in some instances, lead to multiple cemented pipe sizes being required to isolate the wellbore from the uppermost to the deepest production interval. Further when cemented pipe is used, it is not always possible to achieve good initial and long term cement isolation between production intervals. Also the area of perforations contributing production to the wellbore are small relative to the inside diameter of the well and can limit the flow rate from the treated formation.

The geometry of the fracture that can be placed within a cased hole wellbore can also be limited by the casing ID that can be installed across the production intervals and erosion of small flow areas in fracture placement tools and erosion of the casing.

Multiple intervals have been treated in a cased hole with fracture treatments without the use of screens. However, these operations require either wellbore cleanout to remove the treating fluid, including gravel or proppant from the wellbore after the treatment or each fracture treatment to be over-displaced to the formation.

These procedures result in substantial expense and pose certain problems with respect to optimum production of fluids from the formation.

Currently open-hole gravel packing operations are limited to treating single or multiple production intervals in a single treatment operation. In a very few instances, open hole fracture pack operations have been employed but were limited to treating a single production interval or multiple production intervals in a single treatment. This may not provide the optimum treatment or production for each production zone.

In some instances it has been possible to treat selected zones in open hole wellbores by the use of packers, or packers and valves, to isolate the zones for fracturing and the like. However, all such systems typically require the use of packers which are set to isolate the system to be treated or the like. Further it is generally necessary to remove the treating fluid, including gravel or proppant from the wellbore after the treatment is complete or to over-displace each fracture treatment to the formation and to close mechanical fracturing valves.

Since in many instances, a plurality of production intervals may be penetrated by a single open hole wellbore it would be highly desirable to be able to treat and produce these intervals independently in an uncased wellbore penetrating these intervals. Accordingly a considerable effort has been directed to developing such a method.

SUMMARY OF THE INVENTION

It has been found that a plurality of production intervals in an open wellbore are readily treated by positioning an open-hole, single trip, multiple zone fracturing, gravel packing and treatment completion assembly for single trip fracturing and gravel packing intervals in an uncased zone of a wellbore. The open hole portion of the wellbore penetrates a plurality of production intervals. The completion assembly comprises an isolation string having an inside and an outside and an upper end adapted for connection with a lower end of a cemented well casing immediately above the production intervals and a lower end adapted for positioning on an open-hole packer at a selected position in the open hole uncased portion of the wellbore with each section of the isolation string being positioned in one of a plurality of the production intervals and including a first treating valve adapted to open and close a first passageway having an inlet, a second treating pressure monitoring valve adapted to open and close a second passageway having an inlet and a third valve adapted to open and close a third passageway having an inlet, the passageways extending from their inlets through a wall of the isolation string and spaced to provide fluid communication between the inside of the isolation string and the inside of the wellbore in each of a plurality of the production intervals and a screen over openings to the second and third passageways from the wellbore.

The invention further comprises an open-hole, single trip, multiple zone fracturing, gravel packing and treatment completion assembly for single trip fracturing and packing operations in an uncased, open hole portion of a wellbore, the open hole portion penetrating a plurality of production formation intervals, the completion assembly comprising: an isolation string having an inside and an outside and an upper end extending above the completion assembly and adapted for connection in fluid communication with a treating string extending to surface and a lower end which is positioned to carry the completion assembly into the wellbore and adapted to locate the treating string in a selected position in the open hole wellbore; each portion of the treating string being positioned in one of a plurality of production intervals including a first treating valve adapted to open and close a first passageway having an inlet, a second treating pressure monitoring valve adapted to open and close a second passageway having an inlet, the passageways extending from their inlets through a wall of the isolation string and spaced to provide fluid communication between the inside of the treating string and an inside of the wellbore in each of a plurality of the production intervals and a screen over openings to the second and third production passageways from the wellbore.

The invention additionally comprises a method for multiple zone fracturing, packing and well treatment by a single trip for at least one of fracturing, gravel packing and treating an uncased portion of a wellbore, the uncased zone containing a plurality of production intervals, the method comprising: positioning an isolation string having an inside and an outside and an upper end extending above the zone and adapted for connection with a lower end of a cemented well casing in the wellbore and a lower end positioned on an open-hole packer positioned to support the isolation string in a selected position in the uncased portion; each portion of the isolation string being positioned in one of a plurality of production intervals and including a first treating valve adapted to open and close a first passageway having an inlet, a second treating pressure monitoring valve adapted to open and close a second passageway having an inlet and a third production valve adapted to open and close a third passageway having an inlet, the passageways extending through a wall of the isolation string and spaced to provide fluid communication between the inside of the isolation string and an inside of the wellbore in each of a plurality of the production intervals and a screen over the openings to the second and third passageways from the wellbore; passing an inner treating string having an inside and an outside and a crossover tool adapted to pass fluid from the treating string into a production interval; opening a treating valve and a treating pressure monitoring valve and injecting fluid from the tubular treating string into the production interval to fracture, gravel pack or treat the production interval; closing the treating valve and treating pressure monitoring valve; opening the treating valve and a treating pressure monitoring valve in the second production interval and passing fluid from the crossover tool into the second production interval; repeating the treatment steps above for a plurality of production intervals to fracture, gravel pack or treat the production interval; and, opening production valves for selected or all intervals to produce fluids from the production intervals.

DESCRIPTION OF PREFERRED EMBODIMENTS

In the discussion of the Figures, the same numbers will be used throughout to refer to the same or similar components.

Figure 1:
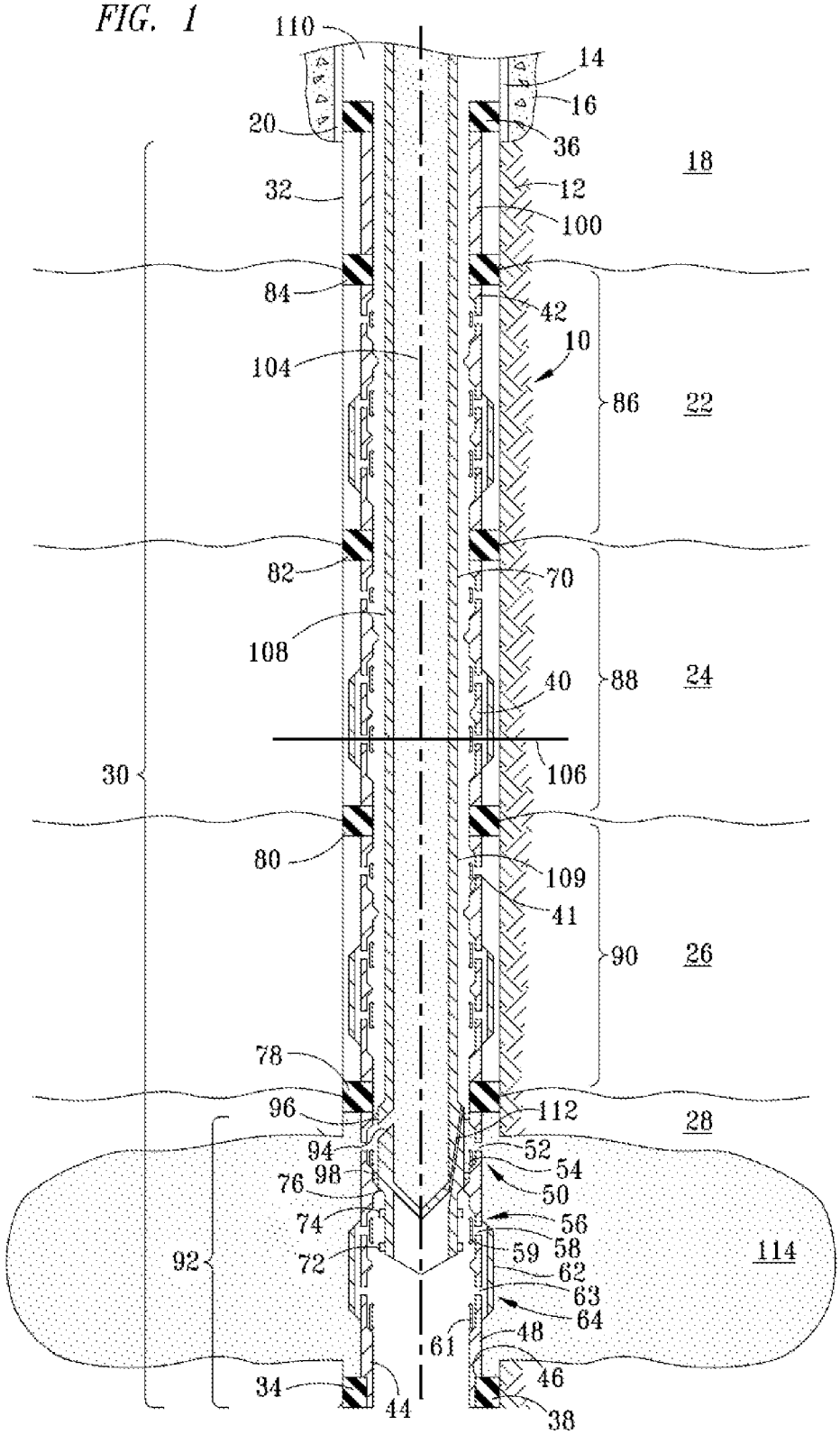
FIG. 1 shows a schematic diagram of a development system including an isolation string positioned in a wellbore for treatment of a lowermost production interval; and, FIG. 2 shows a schematic diagram of the system of FIG. 1 after completion of the treatment of a production interval in a formation positioned for treatment of a second production interval in the formation.

In FIG. 1 a completion assembly 10 is shown positioned in a wellbore 12 which includes a casing 14 cemented in place with cement 16 to a depth above an uncased portion 30. The well penetrates an overburden 18 with a lower end of the casing 20 ending in overburden 18. Formations 22, 24, 26 and 28 are shown and comprise separate production intervals. While not shown, non-production intervals may be, and usually are, positioned between the separate production intervals. These production intervals are penetrated by uncased portion 30 of wellbore 12 which has an upper end 32 and a lower end 34. A packer and a hanger 36 are set in lower end 20 of casing 14 and sealingly position an upper end 42 of an isolation string 40 in casing 14. A base open-hole packer 38 is positioned in a lower portion of the uncased wellbore to support isolation string 40 at its lower end 44. A seal assembly 46 is positioned on packer 38 to sealingly position isolation string 40 in uncased portion 30. A lower extension 48 of isolation string 40 is used to position the valves and screens used for the treatment of each production interval at a desired position in the production interval to be treated. A similar pipe 100 is used in the upper portion of isolation string 40 to position it relative to lower end 20 of casing 14. While not shown, isolation string 40 may include pipe spacer sections between each section of isolation string 40 to position the sections (86, 88, 90 and 92) for treating the production intervals in the production intervals (22, 24, 26 and 28). As shown, isolation string 40 includes a first section 86, a second section 88, a third section 90 and a fourth section 92.

In each production interval a similar arrangement is used for the treatment of the production interval. The treatment is shown in some detail in FIG. 1 for the first lowermost production interval in a production formation 28 with the treated area shown as zone 114. This interval is positioned in a formation 28 and the numeral 114 and the checked area schematically shows the area which has been treated. The treating is accomplished by the use of a first treating valve 50 which opens and closes a first passageway 52 for the passage of treating fluid from inside a treating string 70 positioned inside isolation string 40 and by use of the treating pressure monitoring valve 64, which opens and closes a passageway through screens 62 for the monitoring of treating pressures. Production intervals 22, 24, 26 and 28 are isolated by packers 78, 80, 82 and 84 to separate production intervals for treatment. While fracturing and gravel packing are readily performed using the isolation string, the isolation string can also be used to treat production formations by acid injection and the like. Any treatment delivered as a fluid can be performed, such as scale treatment and the like.

As shown in FIG. 1, the isolation string 40 is positioned in production interval 28 for treatment of the interval. Treating string 70 is positioned in isolation string 40. Isolation string 40 includes a first treating valve 50 comprising a first passageway 52 from the inside of isolation string 40 to the annulus outside of isolation string 40 and inside wellbore 12. Treating valve 50 comprises a plurality of slots, other openings or the like, positioned in a plane 106 which is perpendicular to a longitudinal axis 104 of isolation string 40. The openings (not shown) are opened by moving a first slideable sleeve 54 upwardly and downwardly over the openings. The inside of the sleeve is equipped to matingly engage an opening tool 74 and a closing tool 72 on the outside of treating string 70 which can be used to open and close treating valve 50 and treating pressure monitoring valve 64. Production valve 56 similarly includes a second passageway 58 and a second slideable sleeve 59. The production valve 56 is used to produce the formation fluids following treating operations. A treating pressure monitoring valve 64 also includes a third passageway 63 and a third slideable sleeve 61. The treating pressure monitoring valve 64 provides the ability to monitor treating pressures throughout the treating operations. Further a first screen 62 is positioned to cover the inlet from the wellbore into passageways 58 and 63 so that particulate matter from the treated zone of production interval 28 is not allowed to enter into the inside of isolation string 40.

During the treatment of production interval 28, the treating string is lowered into the inside of isolation string 40 and includes a crossover tool 94. The crossover tool is equipped with seals 96 and 98 which are effective to prevent the passage of fluids from treating string 70 upwardly or downwardly between the inside of isolation string 40 and an outside 108 of the treating string. Fluid is then injected into zone 114 via crossover tool 94 and first passageway 52 to treat production interval 28, as shown by zone 114. During the treatment, treating pressures can be monitored via communication with non-particulate fluids from zone 114 through passageway 63 when the treating pressure monitoring valve 64 is open. Treating pressures may be communicated inside the isolation string 40 and may be passed upwardly through a port 112 into the annulus between an inside 41 of isolation string 40 and the outside 109 of treating string 70. This communication path may enable detection of pressure in production interval 28 during the treatment process.

When the treatment is finished treating string 70 may be raised to treat production interval 26. This same procedure is used and the same arrangement of valves and screen is used in production interval 26. Similarly production intervals 24 and 22 may also be treated in the same way. When it is desired to produce fluids from a treated production interval, after all intervals have been treated and subsequent upper completion operations are complete, production valves 56, can be opened, either mechanically by tools conveyed by standard wellbore intervention methods or initially opened by application of pressure from the surface or by pressure cycles to allow production of formation fluids into the wellbore through the screen sections 62.

Isolation string 40 may also include an indicating coupling 76 positioned to indicate to a tool on the outside of the treating string 70 when it is in proper position relative to each of the production intervals. The production intervals are shown as intervals in the isolation string at 86, 88, 90 and 92.

The production intervals may each be treated with a treating string which may be used to inject material into each of the production intervals for treatment. The treating string may be flushed of materials after each treatment, if desired, by lifting it into the cased portion of the well and introducing sufficient fluid through the annulus between the outside of the treating string and inside 110 of the casing to flow materials up and out of the treating string which should be removed. After the flushing operation has been completed, the treating string may be returned to the desired position in the isolation string.

The isolation string, after the treatments of the well have been finished, may be left in place to maintain the wells in condition to produce from the uncased wellbore interval.

While the treatment of all the sections has not been shown, as indicated the treatment is substantially the same in each interval.

Figure 2:
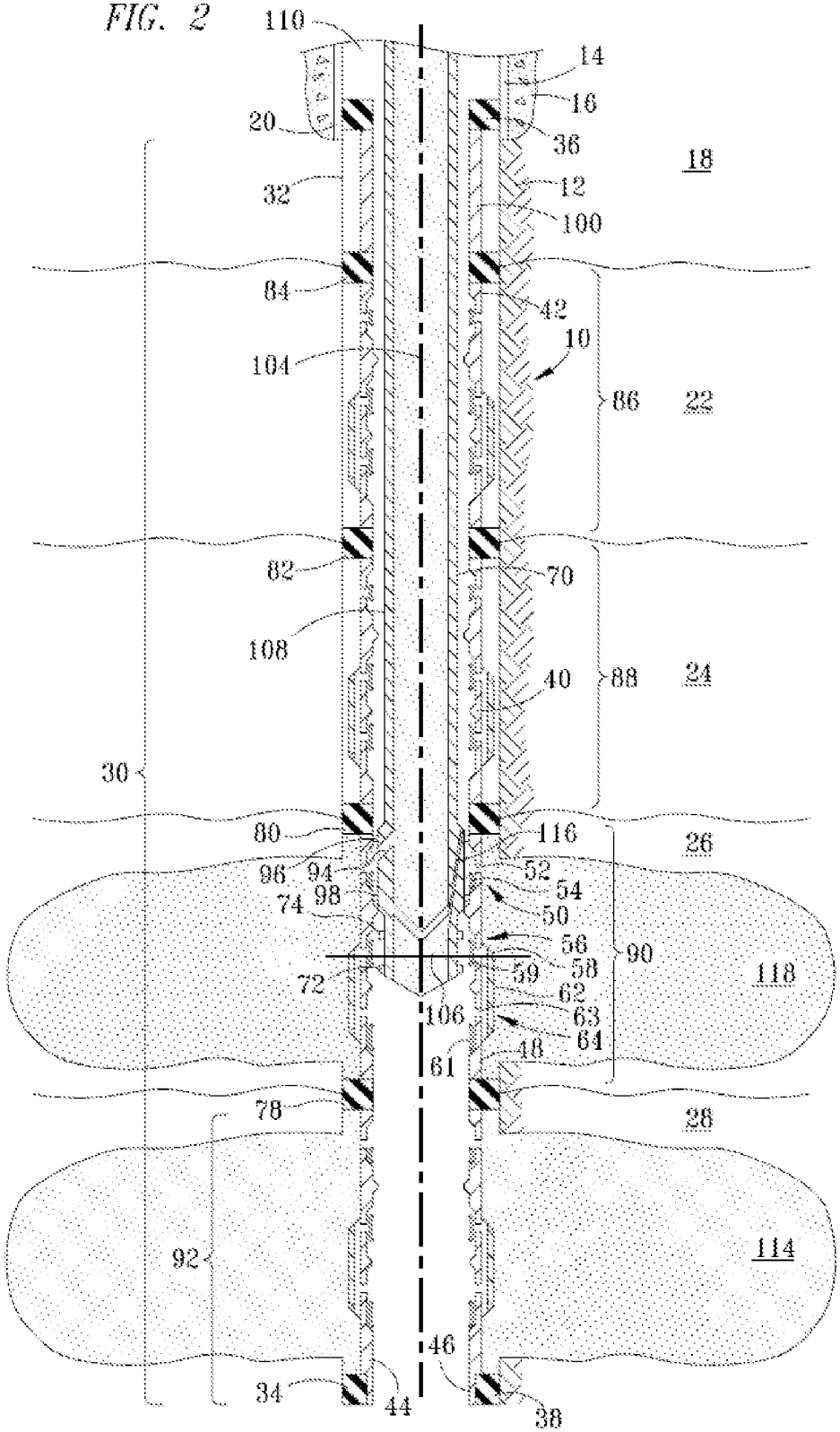

In FIG. 2 the treatment of a second production interval 26 by treatment of a zone 118 is shown.

This treatment permits the use of a single trip downhole with the treating string to set the isolation string in place and perform the selective treatment of multiple intervals. Thus, each of the formations can be treated without a separate setup, isolation of that interval followed by perforation or the like after casing and no cleanout operations to remove treating fluids and proppant from wellbore 12 is necessary.

Desirably the isolation string is constructed and arranged to position the treating valve, treating pressure monitoring valve and production valves and screen opposite the formation to be treated for each production interval in the area to be spanned by the isolation string. This may require the use of spacing pipes in the isolation string as required. The isolation string is then lowered into the wellbore with whatever spacings may be desirable in the isolation string between each set of three valves and screen to enable the treatment of production intervals at whatever spacings they may require. Similarly spacing pipes can be used at the lower and upper ends of the isolation string as required to facilitate is positioning the upper end of the isolation string in the lower end of the casing and its lower end on the base open-hole packer.

The use of tools such as the opening and closing tool on the treating string is well known to those skilled in the art and need not be discussed further.

By use of the method and the apparatus discussed above, it is clear that effective treatment of subterranean zones comprising a plurality of production intervals in an uncased wellbore portion can readily be performed by a single trip method. The method does not require multiple trips in with perforating guns and subsequent fracture packing or gravel packing assemblies and the like to fracture, pack or otherwise treat subterranean formations. Furthermore, the adaptation of open hole isolation packers to the assembly enables multi-zone single trip treating of production intervals in an open hole wellbore. This is a significant advantage and not only eliminates the expense of multiple trips downhole to achieve the desired treatments but also saves the expense of installing casing and cement and eliminates the risk of poor cement jobs which may result in leakage between formations.

Selective open hole fracturing and/or gravel packing of multiple production intervals will result in enhanced productivity by eliminating the near wellbore mechanical restriction associated with perforated casing, allowing optimum fracture and/or gravel packing operations for each interval and by facilitating independent production and reservoir management of each productive interval.

Clearly multiple tubes can be positioned downhole into or through the isolation string to produce separately from each of the formations or from a formation beneath the formations treated as known to those skilled in the art.

As indicated previously, it is believed that it would normally be most desirable to prepare the isolation string at the surface in lengths to position the required valves and screen at each production interval for treatment of the intervals. This will enable the construction of the isolation string, possibly in sections and at distances remote from the oil field. Thus, a tremendous advantage in fabrication can also be achieved.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. An open-hole, single trip, multiple zone fracture pack completion assembly for single trip fracture packing operations in an uncased portion of a wellbore, the uncased portion penetrating a plurality of production intervals, the completion assembly comprising:

a) an isolation string having an inside and an outside and an upper end adapted for connection with a lower end of a cemented well casing in the wellbore and a lower end adapted for positioning on an open-hole packer positioned to support the isolation string in a selected position in the uncased portion;

b) the isolation string comprising a plurality of sections, each section of the isolation string positioned in one of a plurality of the production intervals and including a first treating valve adapted to open and close a first passageway having an inlet, a second treating pressure monitoring valve adapted to open and close a second passageway having an inlet, and a third production valve adapted to open and close a third passageway having an in let, the passageways extending from the inlets through a wall of the isolation string and spaced to provide fluid communication between the inside of the isolation string and the inside of the wellbore in each of the plurality of production intervals and a screen over the openings to the second and third passageways from the wellbore; and (c) a treating string extending from an earth surface into the isolation string, a terminal end of the treating string positioned laterally between the first treating valve and the second treating pressure monitoring valve within the corresponding production interval, the treating string including:

a crossover tool configured to connect to the first treating valve via one or more seals to allow fluid from the treating sting to enter the first passageway without entry into an annulus between an inside of the isolation string and an outside of the treating string, a through port near its distal end allowing treating pressure to be communicated from the second treating pressure monitoring valve upwardly through the port into the annulus between the inside of the isolation string and the outside of the treating string without re-entry into the uncased portion of the wellbore during fracture packing, and at least one tool configured to open and close at least one of the first treating valve and the second treating valve.

2. The completion assembly of claim 1 wherein a plurality of packers are positioned between the outside of the isolation string and the inside of the uncased wellbore to prevent fluid flow between the outside of the isolation string and the inside of the wellbore and to isolate separate production intervals in the uncased zone.

3. The completion assembly of claim 1 wherein the first treating valves and second treating pressure monitoring valves in each section are positioned to treat respective production intervals corresponding to each section.

4. The completion assembly of claim 1 wherein the first and second valves are closed and wherein the third production valves are opened for production from one or more of the treated production intervals.

5. The completion assembly of claim 1 wherein each of the valves comprises a plurality of openings positioned through the isolation string in a plane perpendicular to a longitudinal axis of the isolation string and a slideable sleeve which is adapted for slideable movement along the inside of the isolation string to open and close the plurality of openings comprising the valve by slideable movement responsive to the at least one tool on the treating string to open and close the valves.

6. An open-hole, single trip, multiple zone fracture pack completion assembly for single trip fracture in an uncased portion of a wellbore, the uncased portion penetrating a plurality of production intervals, the completion assembly comprising:

a) an isolation string having an inside and an outside and an upper end extending above the uncased portion and adapted for connection with a lower end of a cemented well casing in the wellbore and a lower end positioned on an open-hole packer positioned to support the isolation string in a selected position in the uncased portion;

b) the isolation string comprising a plurality of sections, each section of the isolation string positioned in one of a plurality of production intervals and including a first treating valve adapted to open and close a first passageway having an inlet, a second treating pressure monitoring valve adapted to open and close a second passageway having an inlet, and a third production valve adapted to open and close a third passageway having an inlet, the passageways extending from the inlets through a wall of the isolation string to provide fluid communication between the inside of the isolation string and an inside of the wellbore in each of a plurality of the production intervals and a screen over openings to the second and third passageways from the wellbore; and (c) a treating string extending from an earth surface into the isolation string, a terminal end of the treating string positioned laterally between the first treating valve and the second treating pressure monitoring valve within the corresponding production interval, the treating string including:

a crossover tool configured to connect to the first treating valve via one or more seals to allow fluid from the treating sting to enter the first passageway without entry into an annulus between an inside of the isolation string and an outside of the treating string, a through port near its distal end allowing treating pressure to be communicated from the second treating pressure monitoring valve upwardly through the port into the annulus between the inside of the isolation string and the outside of the treating string without re-entry into the uncased portion of the wellbore during fracture packing, and at least one tool configured to open and close at least one of the first treating valve and the second treating valve.

7. The completion assembly of claim 6 wherein a plurality of packers are positioned between the outside of the isolation string and the inside of the uncased wellbore to prevent fluid flow between the outside of the isolation string and the inside of the wellbore and to isolate separate production intervals in the uncased zone.

8. The completion assembly of claim 6 wherein the first treating valves and second treating pressure monitoring valves in each section are positioned to treat respective production intervals corresponding to each section.

9. The completion assembly of claim 6 wherein the first and second valves are closed and wherein the third production valves are opened for production from at least a plurality of the treated production intervals.

10. The completion assembly of claim 6 wherein each of the valves comprises a plurality of openings positioned through the isolation string in a plane perpendicular to a longitudinal axis of the isolation string and a slideable sleeve which is adapted for slideable movement along the inside of the isolation string to open and close the plurality of openings comprising the valve by slideable movement responsive to an opening tool and a closing tool on the treating string to open and close the valves.

11. A method for multiple zone fracture packing fracturing, in a single trip in an uncased portion of a wellbore, the uncased portion containing a plurality of production intervals, the method comprising:

a) positioning an isolation string having an inside and an outside and an upper end extending above the uncased portion and sealingly positioning the upper end with a lower end of a cemented well casing in the wellbore and positioning a lower end on an open-hole packer positioned to support the isolation string in a selected position in the uncased portion;

b) positioning respective sections of the isolation string in one of the plurality of production intervals, each section including a first treating valve adapted to open and close a first passageway having an inlet, a second treating pressure monitoring valve adapted to open and close a second passageway having an inlet and a third production valve adapted to open and close a third passageway having an inlet, the passageways extending from the inlets through a wall of the isolation string and spaced to provide fluid communication between the inside of the isolation string and an inside of the wellbore in each of the plurality of production intervals and a screen over openings to the second and third passageways from the wellbore;

c) passing a tubular treating string through the inside of the isolation string to a first production interval, a terminal end of the treating string positioned laterally between the first treating valve and the second treating pressure monitoring valve within the corresponding production interval, the treating string having an inside and an outside, a crossover tool adapted to pass fluid from the treating string into the first production interval, and a through port near a distal end of the treatment string;

d) opening, by at least one tool on the treating string, the first treating valve and second treating pressure monitoring valve and injecting fracture packing fluid from the tubular treating string through the crossover tool into the first production interval to fracture pack the first production interval while monitoring treating pressure through the port in of the treatment string, the port allowing treating pressure to be communicated from the second treating pressure monitoring valve upwardly through the port into an annulus between an inside of the isolation string and an outside of the treating string without reentry into the uncased portion of the wellbore;

e) closing the first treating valve and the second treating pressure monitoring valve;

f) moving the treating string to a second production interval;

g) opening the first treating valve and second treating pressure monitoring valve in the second production interval and passing fracture packing fluid from the treating string through the crossover tool into the second production interval;

h) repeating steps c) through g) for at least one other production interval of the plurality of production intervals to fracture pack said at least one other production intervals; and i) opening the third production valve in at least one of the fracture packed production intervals to produce fluids from at least one of the production intervals in fluid communication with the third production valve.

12. The method of claim 11 wherein the completion system is positioned beneath a cemented casing in the wellbore and wherein residual fluid is removed from the treating string by reverse circulation in the casing.

13. The method of claim 11 wherein the third production valves are opened and closed following treating operations by opening and closing tools conveyed by standard wellbore intervention methods or by application of pressure from surface.

14. The method of claim 11 wherein step (h) comprises repeating steps c) through g) for all other production intervals of the plurality of production intervals to fracture pack all of said production intervals.

* * * * *